US007246383B2

(12) United States Patent
Musal

(10) Patent No.: US 7,246,383 B2
(45) Date of Patent: Jul. 24, 2007

(54) FIT ADJUSTMENT MECHANISM FOR HELMETS

(75) Inventor: Michael J. Musal, Soquel, CA (US)

(73) Assignee: Bell Sports, Inc., Santa Cruz, CA (US)

( * ) Notice: Subject to any disclaimer, the term of this patent is extended or adjusted under 35 U.S.C. 154(b) by 0 days.

(21) Appl. No.: 10/855,185

(22) Filed: May 27, 2004

(65) Prior Publication Data

US 2005/0262618 A1 Dec. 1, 2005

(51) Int. Cl.
*A42B 1/22* (2006.01)

(52) U.S. Cl. ..... 2/418; 2/DIG. 11; 24/68 E

(58) Field of Classification Search ..... 2/421, 2/417, 418, 419, 420, DIG. 11; 24/68 E, 24/16 PB See application file for complete search history.

(56) References Cited

U.S. PATENT DOCUMENTS 1,805,226 A * 5/1931 Richardson ..... 74/576
2,205,742 A 6/1940 Bowers
3,753,452 A * 8/1973 Zebley ..... 74/577 R
3,900,923 A * 8/1975 Thomas ..... 24/16 PB
4,045,001 A * 8/1977 Harvey, Jr. ..... 254/369
4,116,314 A * 9/1978 Ackerman ..... 74/577 S
4,477,929 A 10/1984 Mattsson
4,999,846 A 3/1991 Ball et al.
5,351,339 A 10/1994 Reuber et al.
5,621,923 A 4/1997 Tapocik
5,752,298 A 5/1998 Howell
5,774,953 A * 7/1998 Mao ..... 24/579.09
5,794,272 A 8/1998 Workman et al.
5,896,586 A 4/1999 Freund
6,032,297 A * 3/2000 Barthold et al. ..... 2/416
6,219,851 B1 4/2001 Fang
6,256,798 B1 7/2001 Egolf et al.
6,314,587 B1 11/2001 Fang
6,314,588 B1 11/2001 Fang
6,332,227 B1 12/2001 Fang
6,341,382 B1 1/2002 Ryvin et al.
6,389,606 B1 5/2002 Galet et al.
6,457,210 B1 10/2002 Shirai et al.
6,760,927 B2 * 7/2004 Guay ..... 2/418

FOREIGN PATENT DOCUMENTS

JP 06237805 A * 8/1994

* cited by examiner

*Primary Examiner*—Rodney M. Lindsey
(74) *Attorney, Agent, or Firm*—Womble Carlyle Sandridge & Rice PLLC

(57) ABSTRACT

A fit adjustment mechanism for the headband of a helmet including a bridge and a buckle. The bridge has ratchet teeth extending from the exterior surface. Each of the ratchet teeth has a tapered surface, a top land, and a retention surface with an undercut face beneath the top land. Substantially flat valleys are formed on the exterior surface between each of the ratchet teeth. The buckle includes a clasp that is resiliently and integrally formed on the exterior surface of the base. The clasp has a pawl having an engagement surface so formed to engage the undercut face of the ratchet teeth retention surfaces.

12 Claims, 5 Drawing Sheets

FIT ADJUSTMENT MECHANISM FOR HELMETS

FIELD OF THE INVENTION

The present invention relates to protective headgear, and, more particularly, to mechanisms for adjusting the fit of helmets for outdoor sporting activities.

BACKGROUND OF THE INVENTION

Lightweight helmets for head protection during bicycle falls and accidents have evolved continuously and undergone numerous improvements in recent years. One particular area of refinement has been in the fitting and stabilizing of the helmet on a bicycle rider's head.

The sport of mountain biking has grown increasingly popular in recent years. This activity involves riding specially designed bicycles with heavy duty frames and components on unpaved roads, trails, and rough terrain. Conventional bicycle helmets typically are used for protection from falls. The bouncing, bumping, and jarring associated with such riding, however, exacerbates the fit problem of excessive helmet movement on the rider's head.

One solution to the fit problems of a helmet on a rider's head has been to utilize the undercut portion beneath the occipital region of the rider's head to stabilize the helmet. There are several apparent reasons for this. The first is that the process used to mold a one piece shell of a helmet can not easily tolerate a negative draft angle without prohibitably expensive multi-part molds to allow removal of the helmet after molding. The second reason concerns the difficulty or impossibility of the rider fitting the helmet over his or her head if the helmet contains a substantial inner curve to match the undercut portion of the back of the head. Additionally, without adjustment functionality, the helmet would have to fit the user perfectly, requiring many more shapes and sizes of helmets.

While articulated helmet band constructions have been developed to bias the occipital region of the wearer's head against the main shell portion of the helmet, the lightweight materials, such as nylon, required to provide resilient, strong, and flexible constructions are quite expensive, and too rigid to feel comfortable in a fit belt around the head. More economical, commodity materials such as polyethylene are soft and extremely flexible, but are weak and can creep under loaded conditions.

What is needed is a lightweight, economical helmet band construction that is constructed of more economical commodity materials and yet exhibits the strength and reliability of more expensive engineered materials.

SUMMARY OF THE INVENTION

The present invention is directed to a fit adjustment mechanism for the headband of a helmet, a headband construction, and a sports helmet. The fit adjustment mechanism is both lightweight and constructed of more economical commodity materials, including polyethylene.

One aspect of the present invention is directed to a fit adjustment mechanism for the headband of a helmet. In one embodiment, the fit adjustment mechanism is constructed for use with a headband of the type that snugs the wearer's head forward against the frontal shell of the helmet by securing below the occipital region of the wearer's head. One such headband construction includes a left, or first strap portion, and a right, or second strap portion. Each strap portion fastens to the rear inner shell of the helmet, symmetrically about the center of the shell. The fit adjustment mechanism extends between and is connected to the left and right strap portions.

The fit adjustment mechanism includes a bridge and at least one buckle. In a preferred embodiment, a buckle is integrally formed with each strap portion such that the buckles oppose each other proximate the rear center of the helmet for the simple operation of the fit adjustment mechanism.

The bridge includes a first end, a second end, an interior surface, and an exterior surface. The first end connects the bridge to the buckle on the left strap portion and the second end connects the bridge to the buckle on the right strap portion. A row of ratchet teeth, also known as the tooth rack, extends from the exterior surface of the bridge toward the first end. Another row of ratchet teeth extends from the exterior surface of the bridge toward the second end of the bridge. Each of the ratchet teeth has a tapered surface, a top land, and a retention surface. Unlike the typical saw tooth form in other fit bridge systems, each tooth has a relatively long, flat valley with a short, sharp ramp portion. The top land is minimal and slightly rounded. Rounding the harder material bridge top land gives the softer polyethylene buckle something to slide over without tearing, when under load. When shaped or dimensioned in this manner, the top land prevents the pawl from getting hung up on the top land. As will be appreciated, this eliminates a phenomenon wherein the pawl looses its "memory" over time such that the bias is lost and the pawl will not properly engage the retention surface of the tooth. Otherwise, as the problem with creep was described above, polyethylene would be an unacceptable material choice.

The retention surface of each tooth is formed as an undercut face beneath the top land, providing a "self-energizing" functionality, whereby the buckle pawl tends to "dig deeper" upon loading, as opposed to releasing (failure) by material deformation. This orientation and geometry is unlike typical saw teeth which have a substantially vertical retention surface. Also, unlike the typical saw tooth construction, the construction of the present invention may include substantially flat valleys between each of the ratchet teeth to provide the wearer larger fit increments.

Each buckle of the construction is integrally formed with its associated strap (belt) portion. Thus, the strap portion and buckle can be molded economically as a singular piece. Each buckle comprises an exterior surface upon which a clasp is integrally and resiliently formed. The clasp includes a pawl having an engagement surface that is formed to engage the undercut face of the ratchet tooth retention surface. In a preferred embodiment, the retention surface of the pawl is angled downward toward the undercut face of the ratchet teeth. As will be appreciated, the clasp is selectively movable to a release position so that the pawl is disengaged from the ratchet teeth. This permits the wearer to extend selectively the length of the bridge between the two buckles.

Optionally, the mechanism of the present invention includes a stop, or projection, on the inner surface of the bridge that cooperatively engages a projection, or stop, on the exterior surface of the buckle to limit adjustment of the bridge toward the buckle; i.e., this prevents the closing of the buckles too close together or eccentrically. Further, another stop may optionally be formed on opposed, exterior ends of the bridge to prevent the bridge from being completely pulled free from the clasp.

In use, the user may simply grab each side of the headband construction at the buckles and urge them together if a tighter fit is desired. Alternatively, the user may squeeze the grips which lift and disengage the pawls from the ratchet teeth. The user may then pull the buckles together or apart from one another until the desired fit is achieved, at which point the user can release the clasps so that the pawls will once again engage the ratchet teeth.

These and other aspects of the present invention will become apparent to those skilled in the art after a reading of the following description of the preferred embodiments when considered in conjunction with the drawings. It should be understood that both the foregoing brief description and the following detailed description are exemplary and explanatory only and are not restrictive of the invention as claimed.

DETAILED DESCRIPTION OF THE PREFERRED EMBODIMENTS

Figure 1:
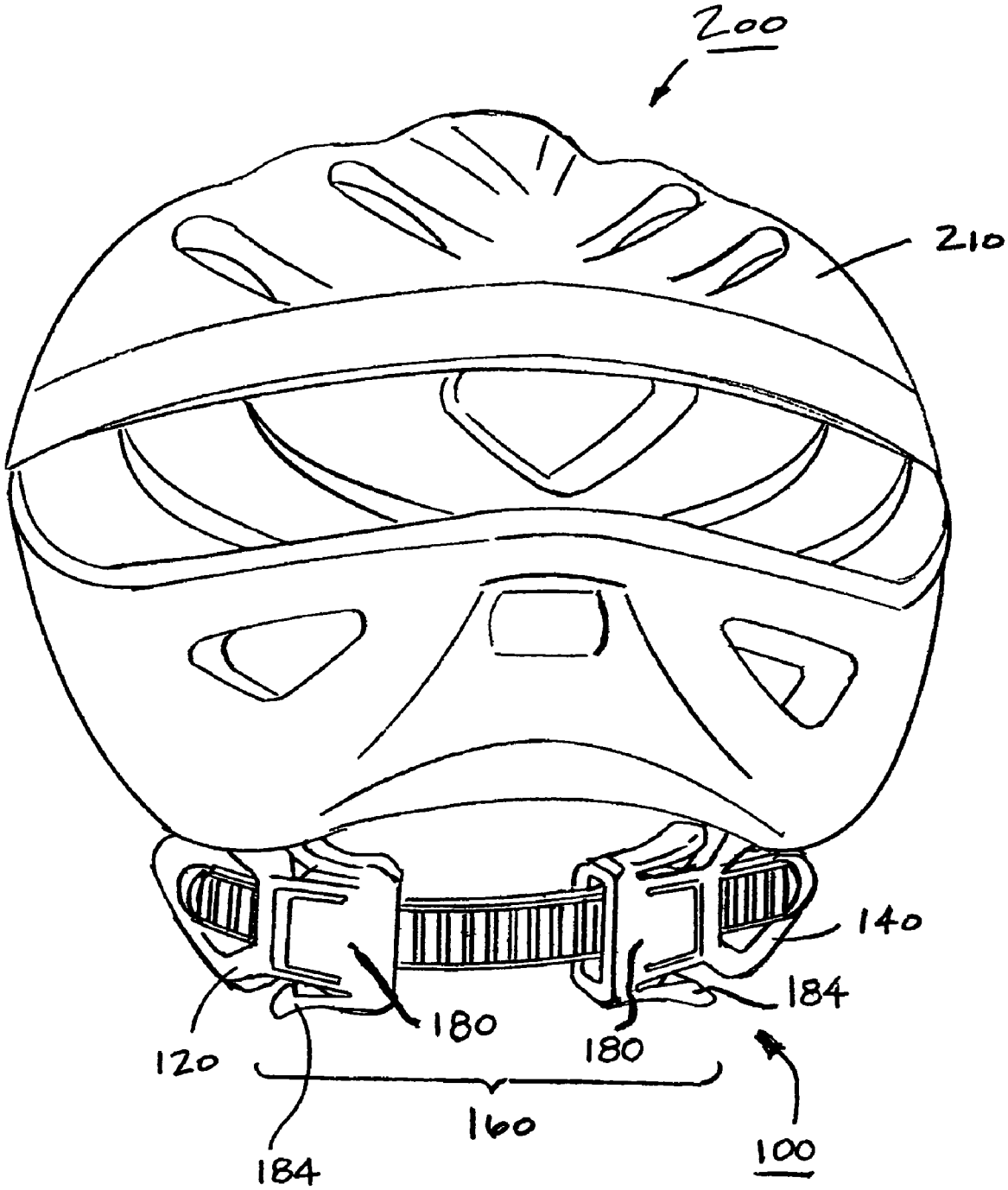
FIG. 1 is a rear perspective view of a sports helmet incorporating the fit adjustment mechanism of the present invention.

Referring first to FIG. 1, the present invention is directed to a fit adjustment mechanism for the headband of a helmet, a headband incorporating the fit adjustment mechanism, and a sports helmet incorporating the headband.

Figure 2:
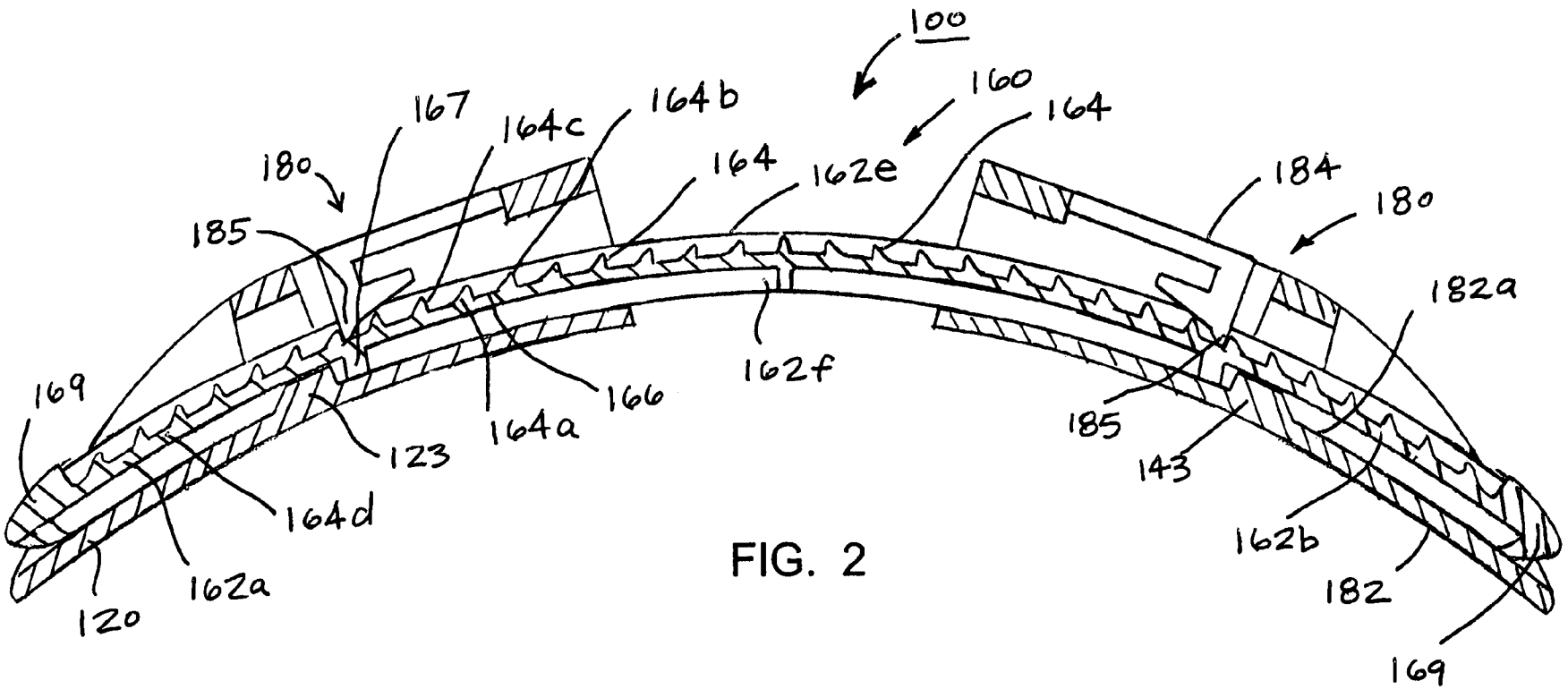
FIG. 2 is a section view of the fit adjustment mechanism of the present invention.

Shown generally as 100 in FIGS. 1 and 2, the headband construction comprises a first strap portion 120, a second strap portion 140, and a fit adjustment mechanism 160 therebetween. When installed in a sports helmet 200, the headband construction 100 will bias the occipital region of the user's head against the front shell portion of the sports helmet 200.

Figure 3:
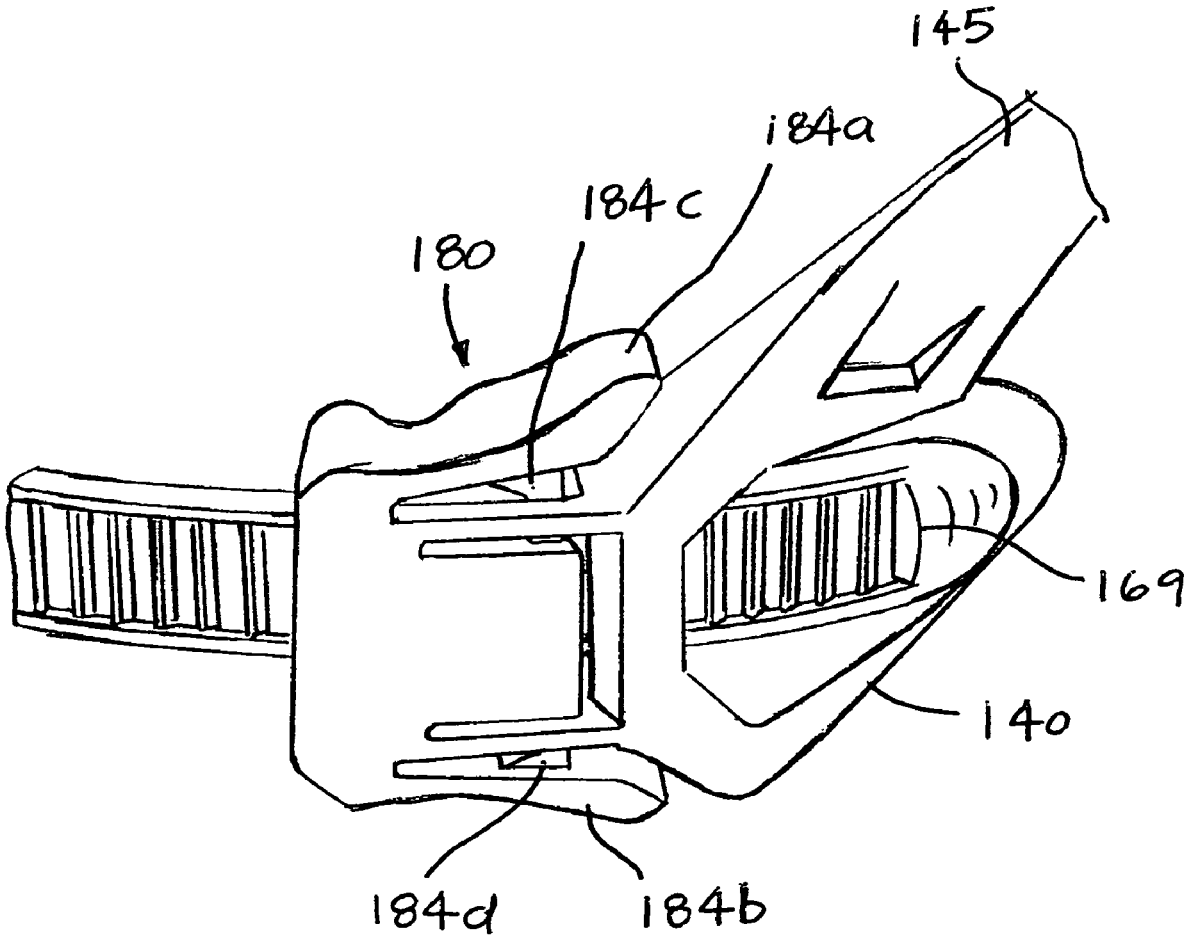
FIG. 3 is rear perspective view of the fit adjustment mechanism of the present invention.

The first and second strap portions 120, 140 are already known in the art and attach at outer opposed points inside the shell 210 of the sports helmet. The headband construction 100 may further include upwardly extending strap portions such as those shown in FIG. 3. When provided, the upwardly extending strap portions are configured for attachment inside the shell 210 of the sports helmet. As those skilled in the art will appreciate, the manner of attachment of straps may take various forms and is not significant to the headband construction 100 described herein. As best shown in FIG. 1, however, the strap portions 120, 140 attach symmetrically about the rear center of the shell 210 of the sports helmet 200.

The fit adjustment mechanism 160 comprises a bridge 162 and at least one buckle 180. The entire construction of the mechanism 160 and the headband construction 100 is formed of the same lightweight, low-cost molded material, wherein the bridge is conventionally molded of a more expensive, rigid material such as nylon. The fit adjustment mechanism 160 is positioned therebetween and connected to the first and second strap portions 120, 140. In a preferred embodiment, the fit adjustment mechanism comprises two symmetrical buckles 180. Each buckle 180 is desirably formed integrally with each strap portion 120, 140 of the same molded material, i.e., polypropylene. So formed, the buckles 180 oppose one another proximate the rear center of the helmet for simple manipulation by the user of the fit adjustment mechanism 160.

The bridge 162 comprises a first end 162*a* and a second end 162*b*, an interior surface 162*d*, and an exterior surface 162*e*. A plurality of ratchet teeth 164 extend upwardly from the exterior surface 162*c* of the first end 162*a* and inwardly toward the center 162*e* of the bridge. As also shown in FIG. 2, the ratchet teeth 164 extending upwardly from the exterior surface 162*c* of the second end 162*b* are also tapered toward the center 162*e* of the bridge 162. Thus, the first and second ends 162*a*, 162*b* and their respective ratchet teeth 164, are symmetrically mirror-imaged about the center 162*e* of the bridge 162.

While the conventional saw tooth form in a bridge construction also comprises a plurality, or series, of ratchet teeth, these conventional constructions of ratchet teeth are tapered, followed by a vertical retention face which terminates sharply at the exterior surface of the bridge. As used herein, "retention face" refers to that surface of the ratchet tooth that engages the buckle so that the bridge is securely held from opening beyond a desired position. The conventional saw tooth geometry, however must be formed of a material that is significantly stronger, and significantly more expensive than the molded polypropylene of the belt/buckle. Otherwise, as has been found, the ratchet tooth material construction with the vertical retention face design weakens over a period of time and ultimately fails to retain engagement with the buckle of the fit mechanism. Also, in squeezing the fit adjustment mechanism closed with one hand, it has been found that the stiffer nylon is better for the bridge, preventing buckling.

Polypropylene, on the other hand, is much less expensive, but has mechanical properties that are very limiting. For instance, molded polypropylene is relatively soft, weak, and extremely flexible. Additionally, it creeps under load. That is, the polypropylene material loses its memory over time, and if deformed in one position long enough, will remain deformed in that position upon release from load.

Figure 2A:
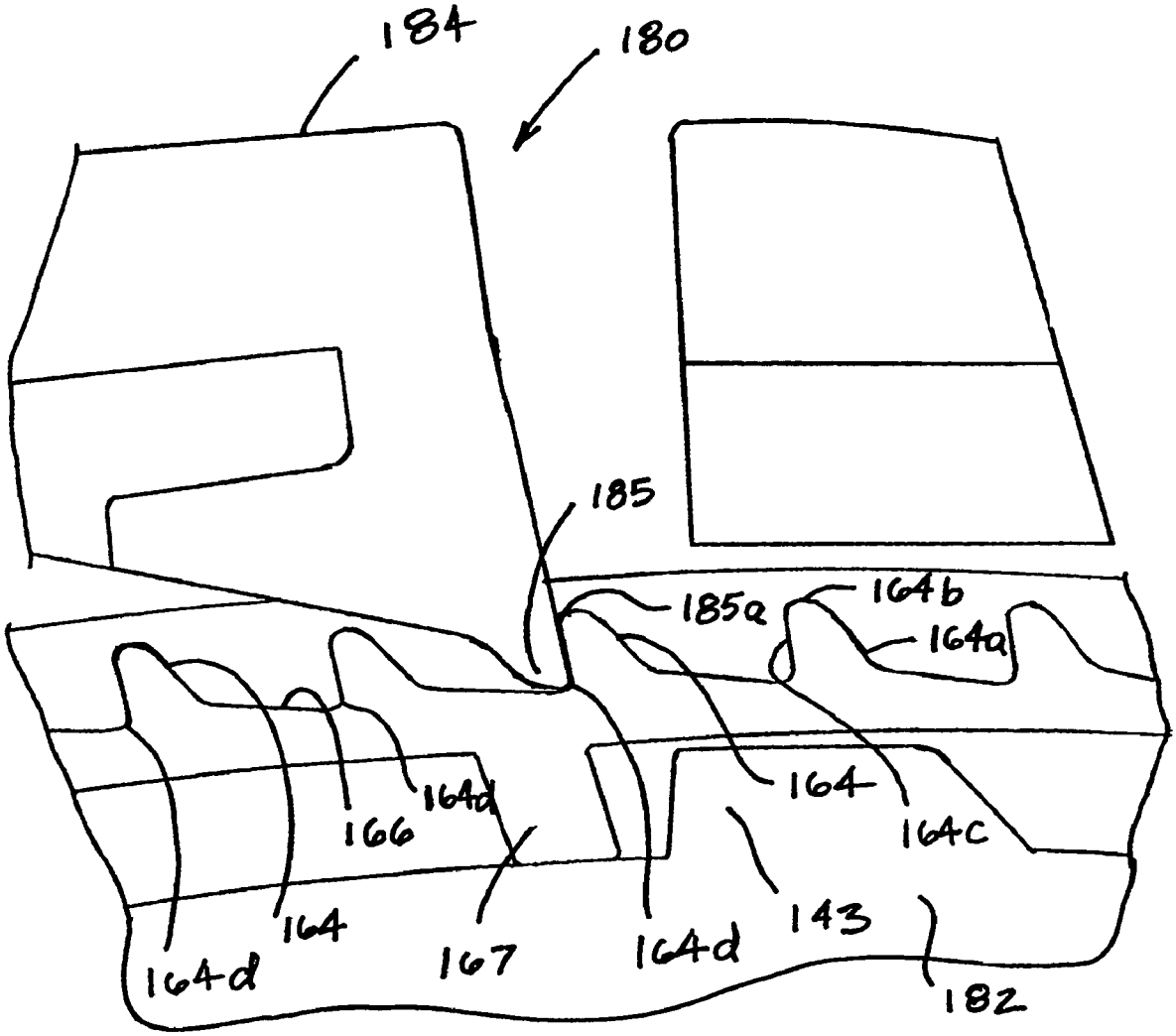
FIG. 2A is an enlarged section view of the ratchet tooth construction of the present invention.

The ratchet teeth 164, and thus the bridge 162, of the present invention are molded of nylon; however, the unique designs of the ratchet teeth 164 and the buckle 180 overcome the material limitations of polypropylene. As best shown in FIG. 2A, each of the ratchet teeth 164 has a short, sharp ramp 164*a*, a relatively narrow or rounded top land 164*b*, and a retention surface 164*c*. The shape of the top land 164*b* prevents the pawl of the buckle mechanism from hanging up (residing) thereon, thus also preventing the buckle from creeping over time. Unlike the retention faces of the prior art saw tooth forms, the retention surface 164*c* of the ratchet tooth 164 of the present invention has an undercut face beneath the land. As such, the retention face extends from the top land down and inward away from the center 162*e* of the bridge 162. This unique geometry of each of the ratchet teeth 164 ensures a positive, strong engagement with the buckle 180.

The fit adjustment mechanism also comprises at least one buckle, and as described above, preferably two. Each buckle 180 comprises a base 182 and a clasp 184. The base 182 has an exterior surface 182*a* to which the clasp 184 is integrally and resiliently formed therewith. The clasp 184 further includes a pawl 185, the pawl 185 having an engagement surface 185*a* that is so formed and shaped to engage the undercut surface 164*c* of the ratchet teeth 164 retention face. As best shown in FIG. 2, the engagement surface 185*a* of the pawl 185 is angled downward in conformance with the geometry of the undercut surface 164*c*. This ensures that the pawl 185 will positively and securely engage the ratchet tooth 164. In one embodiment, the engagement surface 164*c* is angled at about 3 degrees from the vertical and the engagement surface 185*a* of the pawl 185 is angled about 5 degrees from the vertical.

Optionally, the bridge 162 of the headband construction 100 further includes a stop 167 at each end 162*a*, 162*b* on its inner surface. As shown in FIG. 2, the stop 167 projects inwardly. The exterior surface of each strap portion 120, 140 also includes an integrally formed stop 123, 143. As constructed, the stops 167 on each end 162*a*, 162*b* of the bridge 162 and the stops 123, 143 are cooperatively positioned to limit adjustment of the bridge 162 toward the buckle 180. Simply, this prevents the opposed buckles from closing too close together, or more than one half the total adjustment distance by each buckle.

Also, optionally, each end 162*a*, 162*b* of the bridge 162 includes an integrally formed stop 169 formed on the exterior surface 162*c* of the bridge to prevent the bridge from being completely disengaged from the buckle 180 during adjustment by the rider.

Figure 4:
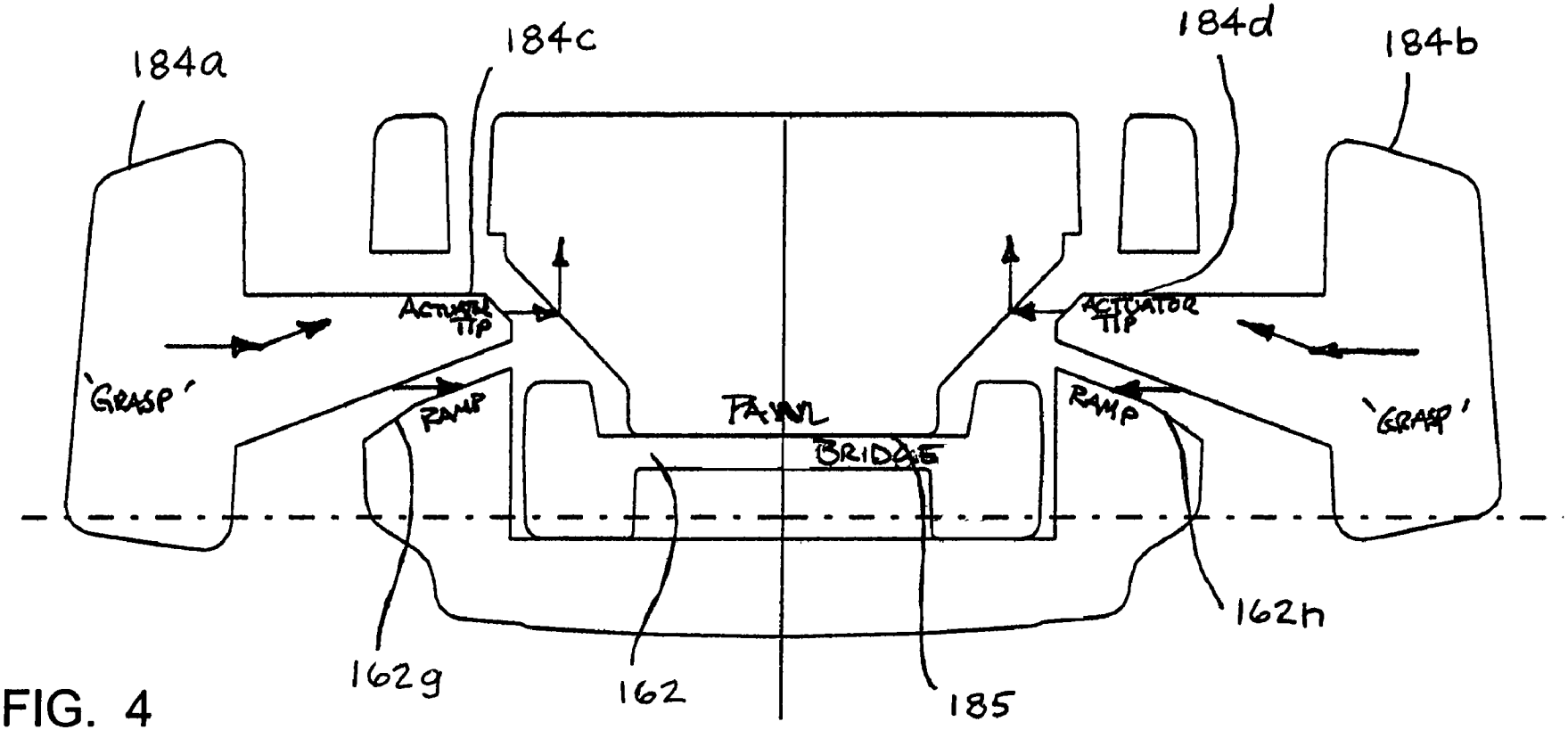
FIG. 4 is a cross-sectional view of the pawl and lifters of the fit adjustment mechanism of the present invention.

As best shown in FIG. 4, operation of the present invention is illustrated. A user may simply grasp the fit adjustment mechanism 160 on either side of the rear center of the hard shell 210 of the sport helmet 200 and urge the buckles 180 together until the desired fit is achieved. To loosen the fit of the mechanism 160, the user need only grasp the clasps 184*a*, 184*b* and squeeze them inward. This also urges the actuator tips 184*c*, 184*d* of the clasps 184 inward. The unique geometry of the actuator tips 184*c*, 184*d* engage and slip upwardly over the ramps 162*g*, 162*h* on either side of the bridge 162. This action engages and lifts the pawl 185 clear of the ratchet teeth 164 and allows the user to pull the buckles 180 further apart from one another. When the desired distance between the buckles 180, and thus the fit, is achieved, the user can release the resilient clasps 184 so that the pawls 185 once again positively and securely engage the ratchet teeth 164.

Although the present invention has been described with exemplary constructions, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A fit adjustment mechanism for the headband of a helmet, comprising:

(a) a bridge having:

(i) a first end, a second end, an interior surface, and an exterior surface;

(ii) a plurality of ratchet teeth extending from the exterior surface toward the first end, each of the ratchet teeth having a tapered surface, a top land, and a retention surface, the retention surface having an undercut face extending downwardly and inwardly beneath the top land, wherein the top land of each of said teeth comprises a rounded tip so that the pawl is prevented from engaging said top land;

(iii) substantially flat valleys formed on the exterior surface between each of said ratchet teeth;

(iv) the bridge formed of a first molded material comprising nylon;

(b) a buckle having:

(i) a base having an exterior surface;

(ii) a clasp resiliently and integrally formed on the exterior surface of said base, the clasp having a pawl, the pawl having an engagement surface so formed to engage the undercut face of the ratchet teeth retention surfaces;

(iii) the clasp being selectively movable to a release position wherein the pawl is disengaged from the ratchet teeth to extend selectively the length of the bridge; and (iv) the buckle formed of a second molded material comprising polyethylene, the second molded material having less rigidity than the first molded material.

2. The mechanism of claim 1 wherein the inner surface of the bridge further includes a stop projecting inwardly, and wherein the exterior surface of the buckle further includes an integrally formed stop, the bridge stop and the buckle stop cooperatively positioned to limit adjustment of the bridge toward the buckle.

3. The mechanism of claim 1 further including a stop formed on the exterior surface of each of the first end and the second end to prevent said bridge from being completely disengaged from said clasp.

4. The mechanism of claim 1 wherein the engagement surface of the pawl is angled downward toward the undercut face of the ratchet teeth.

5. A headband for a helmet, comprising:

(a) first strap portion and a second strap portion;

(b) a fit adjustment mechanism therebetween and connecting to the first and second strap portions, the fit adjustment mechanism comprising:

(i) a bridge having:

a first end, a second end, an interior surface, and an exterior surface;

a plurality of ratchet teeth extending from the exterior surface toward the first end, each of the ratchet teeth having a tapered surface, a top land, and a retention surface, the retention surface having an undercut face extending downwardly and inwardly beneath the land, wherein the top land of said teeth comprises a rounded tip so that the pawl is prevented from engaging the top land;

substantially flat valleys formed on the exterior surface between each of said ratchet teeth;

the bridge formed of a first molded material comprising nylon;

(ii) a buckle having:

a base with an exterior surface;

a clasp resiliently and integrally formed with the exterior surface of said base, the clasp having a pawl, the pawl having an engagement surface so formed to engage the undercut face of the ratchet teeth retention surface;

the clasp being selectively movable to a release position wherein the pawl is disengaged from the ratchet teeth to extend selectively the length of the bridge; and the buckle formed of a second molded material comprising polyethylene, the second molded material having less rigidity than the first molded material.

6. The headband of claim 5 wherein the inner surface of the bridge further includes a stop projecting inwardly, and wherein the exterior surface of the buckle further includes an integrally formed stop, the bridge stop and the buckle stop cooperatively positioned to limit adjustment of the bridge toward the buckle.

7. The headband of claim 5 further including a stop formed on the exterior surface of each of the first end and the second end to prevent said bridge from being completely disengaged from said clasp.

8. The headband of claim 5 wherein the engagement surface of the pawl is angled downward toward the undercut face of the ratchet teeth.

9. A sport helmet, comprising:

(a) a rigid shell assembly for substantially covering a top portion of a wearer's head, the rigid shell having an inner surface and an outer surface;

(b) an adjustable headband attached at point to the inner surface of the rigid shell;

(c) a fit adjustment mechanism for the headband comprising:

(i) a bridge having:

a first end, a second end, an interior surface, and an exterior surface;

a plurality of ratchet teeth extending from the exterior surface toward the first end, each of the ratchet teeth having a tapered surface, a top land, and a retention surface, the retention surface having an undercut face extending downwardly and inwardly beneath the land, wherein the top land of each of said teeth comprises a rounded tip so that the pawl is prevented from engaging said top land;

substantially flat valleys formed on the outer surface between each of said ratchet teeth;

the bridge formed of a first molded material comprising nylon;

(ii) a buckle having:

a base with an exterior surface;

a clasp resiliently and integrally formed with the exterior surface of said base, the clasp having a pawi, the pawl having an engagement surface so formed to engage the undercut face of the ratchet teeth retention surface; and the clasp is selectively movable to a release position wherein the pawl is disengaged from the ratchet teeth to selectively extend the length of the bridge; and the buckle formed of a second molded material comprising polyethylene, the second molded material having less rigidity than the first molded material.

10. The sport helmet of claim 9 wherein the inner surface of the bridge further includes a stop projecting inwardly, and wherein the exterior surface of the buckle further includes an integrally formed stop, the bridge stop and the buckle stop cooperatively positioned to limit adjustment of the bridge toward the buckle.

11. The sport helmet of claim 9 further including a stop formed on the exterior surface of each of the first end and the second end to prevent said bridge from being completely disengaged from said clasp.

12. The sport helmet of claim 9 wherein the engagement surface of the pawl is angled downward toward the undercut face of the ratchet teeth.

* * * * *